United States Patent [19]

Spitzer

[11] Patent Number: 4,655,285

[45] Date of Patent: Apr. 7, 1987

[54] PLUG FOR USE IN HOT OIL TREATMENT OF WELLS HAVING PARAFFIN DEPOSITS AND METHOD OF USE THEREOF

[76] Inventor: William R. Spitzer, P.O. Box 920677, Houston, Tex. 77292

[21] Appl. No.: 708,798

[22] Filed: Mar. 6, 1985

[51] Int. Cl.[4] ..... E21B 33/12; E21B 33/13

[52] U.S. Cl. ..... 166/250; 166/179; 166/304; 166/387

[58] Field of Search ..... 166/302, 304, 312, 188, 166/179, 192, 387, 250

[56] References Cited

U.S. PATENT DOCUMENTS

| | | | |
|---|---|---|---|
| 2,057,966 | 10/1936 | Parrish | 166/179 |
| 2,300,348 | 10/1942 | Dana | 166/304 X |
| 2,999,540 | 9/1961 | Bodine, Jr. | 166/302 |
| 3,361,205 | 1/1968 | Waldron | 166/304 |
| 3,424,249 | 1/1969 | Hamby, Jr. et al. | 166/304 |
| 3,456,734 | 7/1969 | Dean et al. | 166/303 |
| 3,957,108 | 5/1976 | Van Huisen | 166/302 X |

FOREIGN PATENT DOCUMENTS

| | | | |
|---|---|---|---|
| 889834 | 12/1981 | U.S.S.R. | 166/304 |

*Primary Examiner*—Stephen J. Novosad
*Assistant Examiner*—Michael A. Goodwin
*Attorney, Agent, or Firm*—Neal J. Mosely

[57] ABSTRACT

A plug for use in reducing paraffin deposits inside a production tubing string within a casing is slidably received on one of the production string tubing joints and supported on a tubing string collar. The outside diameter of the plug is smaller in diameter than the drift diameter of the casing to provide an annular space therebetween. When hot oil is pumped down the annulus between the tubing and the casing during a hot oil treatment, this plug restricts flow of the hot oil by allowing the oil to pass through the annular space between the plug and the casing and through a series of circumferentially spaced apertures through the body. The reduced flow rate increases contact time to produce the maximum heat transfer between the hot oil and the tubing, rods, and fluid inside the tubing. The paraffin melts and is produced along with the well fluids. The apertures allow passage of pressurized gases from the annulus below the hot oil plug to the annulus above the hot oil plug to prevent gas locking and reduced production through the production tubing. The plug may also have a plurality of circumferentially spaced check valves in place of, or in combination with the apertures to allow passage of the pressurized gases.

17 Claims, 5 Drawing Figures

PLUG FOR USE IN HOT OIL TREATMENT OF WELLS HAVING PARAFFIN DEPOSITS AND METHOD OF USE THEREOF

BACKGROUND OF THE INVENTION

1. Field of the Invention

This invention relates to means for reducing paraffin deposits in the production tubing of oil wells, and more particularly to a hot oil plug supported on a tubing string collar within a casing to restrict the flow of hot oil pumped into the casing-tubing annulus to provide sufficient contact time for maximum heat transfer between the hot oil and the tubing, rods, and fluid inside the tubing, causing the paraffin to melt and be produced along with the well fluids.

2. Brief Description of the Prior Art

Restricted production is a common problem in oil wells producing oil with a high level of paraffin content. Paraffin wax collects on the tubing and flowline walls and on the body of the sucker rods (in the case of pumping wells). The paraffin buildup may eventually cause blockage, and measures must be taken to remove it.

Common methods for removing the paraffin deposits include scraping the interior of the production tubing, or closing down the well and washing with a suitable paraffin solvent. The result in either event is costly in a direct material way as well as in the loss of production.

The method of paraffin removal most often used on pumping wells is "hot oiling," which involves pumping hot oil, at about 160° to 280° F. down the annular space between the tubing and the casing. The hot oil heats the tubing, rods, and fluid inside the tubing, to melt the paraffin for production along with the well fluids.

The major problem with the "hot oil" treatment is that most pumping wells have very low producing bottom hole pressures. As a result, the hot oil falls down the annulus so fast that there is insufficient contact time for efficient heat transfer, and the effectiveness of the treatment is reduced.

Prior art methods include complex apparatus directed toward removing debris from well bores and for chemically treating wells which must be installed in the well bore or on the tubing string. There are sevreal patents on apparatus and methods directed toward restricting paraffin formation in wells.

Tuggle et al, U.S. Pat. No. 3,454,464 discloses a method for restricting paraffin deposits in flowing oil wells by effecting a sharp drop in pressure sufficient to refrigerate the flow by vaporization and expansion of normally gaseous fractions and precipitate the wax as suspended particles which flow away with the produced oil.

Hewes, U.S. Pat. No. 4,049,057 discloses a valve unit which is placed in the eduction tube of an oil well used for removal of paraffin. The unit contains one ball valve to discharge fluid from the eduction tube into the annulus between the tube and the casing, and another ball valve to receive fluid from the annulus into the eduction tube.

McCulloch, U.S. Pat. No. 2,798,558 discloses a well completion apparatus comprising a packing member which isolates the annulus between the casing and tubing. An elongated conduit containing a valve extends through the packing member to allow communication between the annular with the casing below the tower open end of the tubing. The invention is directed to apparatus for conducting operations in a well casing without manipulating tubing therein.

Neither the prior art in general nor these patents in particular disclose the present invention of a hot oil plug which is slidably received on the production tubing string and supported on one of the tubing string collars within a casing, the outside diameter of the plug being smaller in diameter than the drift diameter of the casing to provide an annular space therebetween. The hot oil plug restricts the rate of flow of hot oil pumped into the casing-tubing annulus by allowing the oil to pass slowly through the annular space between the plug and the casing and through a series of circumferentially spaced apertures resulting in a reduced flow rate providing sufficient contact time to produce maximum heat transfer between the hot oil and the tubing, rods, and fluid inside the tubing, causing the paraffin to melt and be produced along with the well fluids.

The apertures allow passage of pressurized gases from the annulus below the hot oil plug to the annulus above the hot oil plug to prevent gas locking and reduced production through the production tubing. The plug may also be provided with a series of circumferentially spaced check valves in place of, or in combination with the apertures to allow passage of the pressurized gases.

SUMMARY OF THE INVENTION

It is therefore one object of the present invention to provide an apparatus for use in reducing paraffin deposits in production tubing and flowlines.

Another object of this invention is to provide a hot oil plug which will greatly improve the effectiveness of hot oil treatments.

Another object of this invention is to provide a hot oil plug which will reduce the overall operating costs of wells which produces oil having paraffin wax in the product.

Another object of this invention is to provide a hot oil plug which will not restrict gas flow up the annulus thereby reducing the possibility of gas locking and reduced production.

Another object of this invention is to provide a hot oil plug which will not interfere with diagnostic well equipment designed to determine the producing fluid level in the tubing-casing annulus.

Another object of this invention is to provide a hot oil plug which may be easily installed and removed from the production tubing.

Another object of this invention is to provide a hot oil plug which is simple in design and may be manufactured inexpensively.

Other objects of the invention will become apparent from time to time throughout the specification and claims as hereinafter related.

The above noted objects and other objects of the invention are accomplished by a hot oil plug which is slidably received on the production tubing string and supported on one of the tubing string collars within a casing, the outside diameter of the plug being smaller in diameter than the drift diameter of the casing to provide an annular space therebetween. The hot oil plug restricts the rate of flow of hot oil pumped into the casing-tubing annulus by allowing the oil to pass through the annular space between the plug and the casing and through a series of circumferentially spaced apertures resulting in a reduced flow rate providing sufficient contact time to produce maximum heat transfer between the hot oil and the tubing, rods, and fluid inside the tubing, causing the paraffin to melt and be produced along with the well fluids.

The apertures allow passage of pressurized gases from the annulus below the hot oil plug to the annulus above the hot oil plug to prevent gas locking and reduced production through the production tubing. The plug may also be provided with a series of circumferentially spaced check valves in place of, or in combination with the apertures to allow passage of the pressurized gases.

DESCRIPTION OF THE PREFERRED EMBODIMENT

Figure 1:
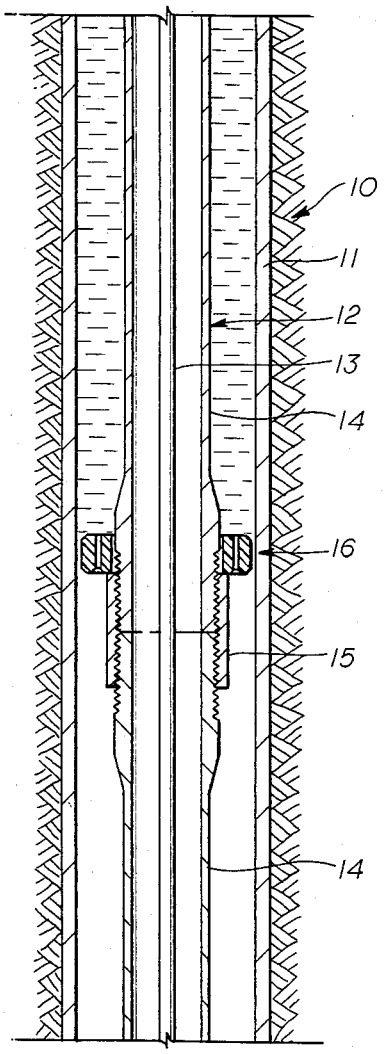
FIG. 1 is a view in longitudinal cross section of a portion of a pumping well.

Referring to the drawings by numerals of reference, and particularly to FIG. 1, there is shown a lower portion of a conventional pumping well 10 having a well bore casing 11, a generally concentrically disposed production tubing string 12 defining an annulus therebetween, and a reciprocating sucker rod 13 within the production tubing. The production tubing string 12 is commonly made up of a series of tubing joints 14 having threaded ends connected by threaded collars 15. A preferred hot oil plug 16 is shown installed on such a connection.

Crude oil carrying both gases and normally solid paraffin in solution tend to commence precipitating the paraffin waxes at a temperature which normally prevails a substantial distance up the wellbore. The hot oil plug may be installed on the connection nearest the precipitation point, or a special length tubing joint may be installed in the tubing string for a more strategic placement.

Figure 2:
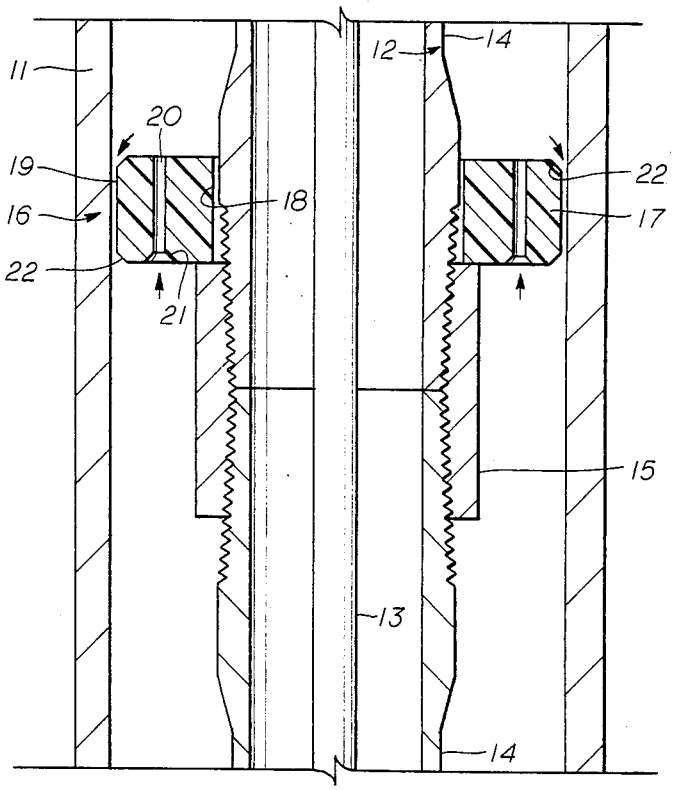
FIG. 2 is an enlarged detail in cross section of a preferred embodiment of a hot oil plug installed on a production tubing string.

As shown in FIG. 2, the hot oil plug 16 comprises a generally cylindrical body 17 having an inside diameter 18 and an outside diameter 19. The inside diameter 18 is larger in diameter than the outer diameter of the threaded ends of the tubing joints 14, but smaller in diameter than the outer diameter of the threaded collar 15. The outside diameter 19 is approximately ¼" smaller in diameter than the drift diameter of the casing 11. The body 17 substantially fills the annulus between the tubing 14 and the casing 11, except for a small annular space between the circumference of the body and the internal diameter of the casing.

Figure 3:
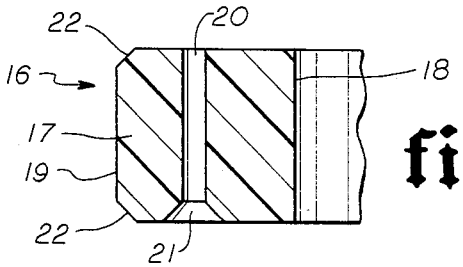
FIG. 3 is an enlarged detail of a portion of the hot oil plug in accordance with the present invention.

As best shown in FIGS. 2 and 3, a series of circumferentially spaced apertures 20 extend vertically through the body 17. The apertures 20 are spaced approximately midway between the inside diameter 18 and the outside diameter 19. An inwardly tapered counterbore 21 is formed at the bottom of each aperture. Chamfers 22 are provided at the outer top and bottom edges of the body 17.

Figure 4:
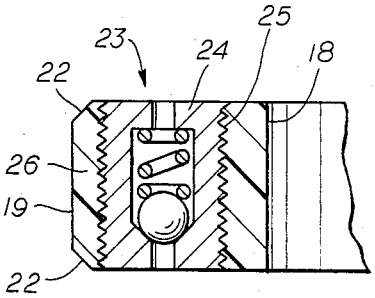
FIG. 4 is an enlarged detail of a portion of a modified hot oil plug in accordance with the present invention.
Figure 5:
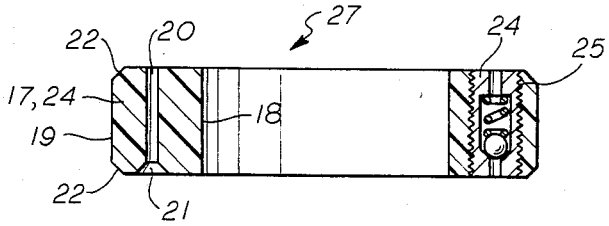
FIG. 5 is an elevational view in cross section of another modification of the hot oil plug in accordance with the present invention.

FIG. 4 shows an alternate embodiment of hot oil plug 23 in which a series of circumferentially spaced check valve members 24 are substituted for the apertures 20. In the embodiment shown, a series of threaded bores 25 extend vertically through the body 26. Conventional check valves 24 are threadedly secured in the threaded bores 25. It should be understood that while a threaded connection is shown, other methods may be used to provide the body with check valve means. The check valves 24 are positioned to open upon sufficient pressure directed to the bottom of the body 26. FIG. 5 shows a hot oil plug 27 having a combination of apertures 20, and check valves 24. To avoid repetition, the the same reference numerals are assigned to the same parts, the placement and description of which are described above and not repeated here.

The purpose of the apertures and/or the check valves is to allow gas pressure in the annulus below the plug to pass through the body of the plug to the annulus above the body so as not to restrict normal gas flow up the annulus thereby reducing the possibility of gas locking and reduced production. The clearance between the inside diameter of the plug and the tubing joint, and the outside diameter of the plug and the casing is such that the plug will be raised off of the top of the collar upon sufficient pressure directed to the bottom of the body to additionally relieve pressure.

The hot oil plug may be made from a variety of materials, although a thermoplastic material is preferable. One advantage of a suitable thermoplastic material is that it will allow the plug to be broken or fractured in an emergency or should the plug become lodged in the well bore or on the production string. Fracturing the plug is accomplished by raising or lowering the production tubing such that the plug is captured between the collar and an obstruction on the wall of the casing. Continued movement of the tubing will fracture the body. The hot oil plug may also be drilled out if necessary.

OPERATION

Referring now to FIG. 1, after determining the depth at which precipitation of the paraffin commences, the hot oil plug 16 is placed onto the appropriate tubing joint 14 and the collar 15 is made up in the conventional manner. The production tubing and hot oil plug 16 is run into the well bore casing 11 to the predetermined depth. The hot oil plug 16 is supported on the collar 15 with approximately ¼" clearance between the outside diameter 19 of the body and the drift diameter of the well bore casing 11.

Crude oil carrying both gaseous and normally solid paraffin in solution tend to commence precipitating the paraffin waxes at a temperature which normally prevails a substantial distance up the wellbore. The hot oil plug may be installed on the connection nearest the precipitation point, or a special length tubing joint may be installed in the tubing string for a more strategic placement.

When it is desired to remove the paraffin deposits with a hot oil treatment, hot oil at a temperature of about 160° to 280° F. is pumped down the annular space between the tubing and the casing. The hot oil plug 16 restricts the rate of flow of the hot oil by allowing the oil to pass through the annular space between the plug and the casing and through the apertures 19. The reduced flow rate allows sufficient contact time to produce the maximum heat transfer between the hot oil and the tubing, rods, and fluid inside the tubing, causing the paraffin to melt and be produced along with the well fluids.

The apertures and/or check valves in the body of the plug allow gas pressure below the plug to pass through the body of the plug so as not to restrict gas flow up the annulus thereby reducing the possibility of gas locking and reduced production.

If for some reason the plug must be removed quickly, it may be broken or fractured by raising or lowering the production tubing in a manner to cause the plug to become lodged such that the plug is captured between the collar and an obstruction on the wall of the casing. Continued movement of the tubing breaks the body of the plug. The hot oil plug may also be easily drilled out.

Tests were recently performed in a field having of 180 producing wells of which 140 were on sucker rod lift. The hot oil plug was installed on the production string of 60 of the pumping wells. The plug was installed on the production tubing string so that the final setting depth was between 2,500 and 3,000 feet. This is the depth range at which wellbore temperatures are cool enough to allow paraffin deposition to start. It was found during hot oil treating the wells, that use of the hot oil plug reduced the velocity of hot oil flowing down the tubing-casing annulus to provide increased contact time between the heated oil and the portion of the tubing string where paraffin forms, allowing more efficient heat transfer and resulting in improved paraffin removal.

Not only did the hot oil plug make hot oil treatments much more effective, but it was found that the time period between treatments was increased from two to four times the period required in the conventional method before the paraffin reformation began to restrict production. This increased time period between treatments results in the added benefit of reduced operating costs for wells equipped with the plug.

Two major concerns during the testing were;

(1) the possibility that gas flow up the annulus would be restricted, causing gas locking and reduced production and;

(2) that use of the plug would interfere with diagnostic well equipment designed to determine the producing fluid level in the tubing-casing annulus.

The testing which covered six months indicated that where gas production is moderate (less than 150 MCFPD), there are no detrimental production effects. Furthermore, fluid levels can still be determined by using either a gas operated acoustical well sounder, or by calculating the fluid levels from dynamometer card readings.

While this invention has been described fully and completely with special emphasis upon several preferred embodiments, it should be understood that within the scope of the appended claims the invention may be practiced otherwise than as specifically described herein.

I claim:

1. A system of apparatus for removal of paraffin deposits from an oil or gas well comprising in combination;

a well bore in the earth, a casing lining said well bore, a production tubing string within said casing, means forming a shoulder on said tubing string at a predetermined distance below the surface of the earth, a hot oil plug removably positioned on said shoulder means comprising a cylindrical body having a central cylindrical bore therethrough having a loose fit on said tubing string, said hot oil plug providing an obstruction when hot oil is introduced into the annular space around said tubing string for melting paraffin deposits, and the outer surface of said body being sufficiently smaller in diameter than the drift diameter of said casing to provide an annular space therebetween of a size permitting passage of hot oil therethrough at a predetermined rate to provide sufficient time of contact between the hot oil and the exterior surface of said tubing string for maximum heat transfer therebetween, and pressure relief means on said said hot oil plug for allowing passage of pressurized gases from the annular space below the plug to the annular space above the plug.

2. A system of apparatus according to claim 1 in which said tubing string comprises a plurality of tubing joints and collars joining the same, at least one of said collars comprising said shoulder forming means, and said central cylindrical bore of said hot oil plug being slidably received on one of said tubing joints to support said cylindrical body on one of said collars.

3. A system of apparatus according to claim 1 in which said tubing string comprises a plurality of tubing sections each with enlarged tool joint end portions and collars joining the same, at least one of said collars comprising said shoulder forming means, and said central cylindrical bore of said hot oil plug being of a size slidably received on one of said enlarged tool joint end portions to support said cylindrical body on one of said collars.

4. A system of apparatus according to claim 1 in which said pressure relief means comprises;

a plurality of circumferentially-spaced vertical apertures through said body of sufficient size to allow passage of hot oil at a predetermined rate to provide sufficient time of contact between the hot oil and the exterior surface of said tubing string for maximum heat transfer therebetween, and said apertures allowing passage of pressurized gases from the annular space below the plug to the annular space above the plug.

5. A system of apparatus according to claim 1 in which said tubing string comprises a plurality of tubing joints and collars joining the same, at least one of said collars comprising said shoulder forming means, said central cylindrical bore of said hot oil plug being slidably received on one of said tubing joints to support said cylindrical body on one of said collars, said hot oil plug has a plurality of circumferentially-spaced vertical apertures through said body of sufficient size to allow passage of hot oil at a predetermined rate to provide sufficient time of contact between the hot oil and the exterior surface of said tubing string for maximum heat transfer therebetween, and said apertures allowing passage of pressurized gases from the annular space below the plug to the annular space above the plug.

6. A system of apparatus according to claim 4 in which said hot oil plug has a plurality of circumferentially spaced check valves in selected ones of said apertures to permit passage of pressurized gases from the annulus below the hot oil plug to the annulus above the hot oil plug.

7. A plug for use in the hot oil process of reducing paraffin deposits inside a production tubing string within a casing in a well bore in the earth comprising;

a cylindrical body adapted to be supported on a tubing joint connection of said production tubing string within said casing, said cylindrical body having an outer diameter sufficiently smaller than the drift diameter of the casing in which it is to be installed to provide an annulus space of a size operable to allow passage of hot oil therethrough at a predetermined rate to provide sufficient time of contact between the hot oil and the exterior surface of the tubing string for maximum heat transfer therebetween, and pressure relief means on said said hot oil plug for allowing passage of pressurized gases from the annular space below the plug to the annular space above the plug when installed in a well.

8. A plug according to claim 7 in which said plug is for use in a tubing string formed of a plurality of tubing joints joined by collars, and said plug comprises a cylindrical body having a central cylindrical bore therethrough, said central cylindrical bore being adapted to be slidably received on one of said tubing joints to support said cylindrical body on one of said collars.

9. A plug according to claim 7 in which said body has a plurality of circumferentially spaced vertical apertures therethrough of sufficient size to allow passage of hot oil therethrough at a predetermined rate to provide sufficient time of contact between the hot oil and the exterior surface of said tubing string for maximum heat transfer therebetween when used in the hot oil process for paraffin removal from well tubing, and said apertures allowing passage of pressurized gases from the annulus below the plug to the annulus above the plug.

10. A plug according to claim 9 in which said body has a plurality of circumferentially spaced check valves operatively contained within selected ones of said apertures for allowing passage of pressurized gases from the annulus below the plug to the annulus above the plug.

11. A plug according to claim 7 in which said body has a plurality of circumferentially spaced vertical apertures therethrough of sufficient size to allow passage of hot oil therethrough at a predetermined rate to provide sufficient time of contact between the hot oil and the exterior surface of said tubing string for maximum heat transfer therebetween when used in the hot oil process for removal of paraffin deposits from well tubing, said apertures allowing passage of pressurized gases from the annulus below the plug to the annulus above the plug, and a series of circumferentially spaced check valves operatively contained within selected ones of said apertures in said body for allowing passage of pressurized gases from the annulus below the plug to the annulus above the plug.

12. An improved method of reducing paraffin deposits inside a production tubing string within a casing in an oil or gas well comprising the steps of;

determining the depth below the surface at which precipitation of paraffin wax commences, installing an annular fluid flow restricting means on the exterior of said production tubing string to form a small annular space between the outer surface of said fluid flow restricting means and the drift diameter of said casing, locating said fluid flow restricting means within said casing below the point at which precipitation of paraffin wax commences, pumping hot oil into the annulus between the production tubing string and casing above the fluid flow restricting means and allowing controlled flow of the hot oil past said fluid flow restricting means through said annular space at a predetermined rate to provide sufficient time of contact between the hot oil and the exterior surface of said tubing string for maximum heat transfer therebetween to melt the precipitated paraffin, and allowing passage of pressurized gases upwardly past said fluid flow restriction means from the annulus below said fluid restricting means to the annulus above said fluid flow restricting means.

13. A method according to claim 12 in which passage of pressurized gases upwardly past said fluid flow restriction takes place through the small annular space between the outer surface of said fluid flow restricting means and the drift diameter of said casing.

14. A method according to claim 12 in which the controlled flow of hot oil past said fluid flow restricting means takes place through the small annular space between the outer surface of said fluid flow restricting means and the drift diameter of said casing and through a plurality of circumferentially spaced apertures provided through said fluid restricting means, and passage of pressurized gases upwardly past said fluid flow restriction takes place through said plurality of circumferentially spaced apertures.

15. A method according to claim 14 in which passage of pressurized gases upwardly past said fluid flow restriction takes place through valve means installed in certain ones of said plurality of circumferentially spaced apertures.

16. A method according to claim 12 in which said tubing string comprises a plurality of tubing joints and collars joining the same, at least one of said collars forming a shoulder on said tubing string to reside within said casing below the point at which precipitation of paraffin wax commences, removably positioning said fluid flow restriction means on said shoulder when making up said tubing joints and thereafter lowering said tubing string into said casing.

17. A method according to claim 12 in which said tubing string comprises a plurality of tubing sections each with enlarged tool joint end portions and collars joining the same, at least one of said collars forming a shoulder on said tubing string means to reside within said casing below the point at which precipitation of paraffin wax commences, slidably positioning said fluid flow restricting means on one of said enlarged tool joint end portions to support same on said shoulder.

* * * * *